US005514055A

United States Patent [19]

Elliott

[11] Patent Number: 5,514,055

[45] Date of Patent: May 7, 1996

[54] EXERCISE AND STRESS-RELIEF DEVICE

[76] Inventor: Daniel K. Elliott, 2330 Whitehead Rd., Suwanee, Ga. 30174

[21] Appl. No.: 336,772

[22] Filed: Nov. 9, 1994

[51] Int. Cl.[6] ..... A63B 21/00

[52] U.S. Cl. ..... 482/92; 482/121

[58] Field of Search ..... 482/92, 74, 121, 482/126, 131, 148, 122, 124, 127, 128, 129, 133; 138/134, 135

[56] References Cited

U.S. PATENT DOCUMENTS

| | | | |
|---|---|---|---|
| 2,083,937 | 6/1937 | Begg | 138/134 |
| 2,092,898 | 9/1937 | Tondeur | 138/134 |
| 4,249,729 | 2/1981 | Gabrielidis | 273/29 A |
| 4,651,985 | 3/1987 | Salisbury | 272/68 |
| 4,711,445 | 12/1987 | Whitehead | 272/67 |
| 4,856,776 | 8/1989 | Ching-Liang | 272/142 |
| 5,022,648 | 6/1991 | Travis | 272/137 |

*Primary Examiner*—Stephen R. Crow
*Attorney, Agent, or Firm*—Kenneth S. Watkins, Jr.

[57] ABSTRACT

An exercise and stress-relief device is disclosed comprising a bending tube and a cover. The bending tube comprises a spring and a friction element. Application of an increasing bending force results in the reduction of the radius of curvature of the device. Removal of the bending force results in the device maintaining its shape if the radius of curvature is greater than or equal to the critical radius of curvature. A reversed bending force is required to straighten the device at a radius of curvature greater than or equal to the critical value. At a radius of curvature less than the critical value, the device acts in a conventional spring manner. The preferred embodiment of the device comprises a resilient foam cover and end caps. It can be used as a hand exerciser in short lengths or an arm/upper torso exercise device in longer lengths. The device provides a stress-reduction function from its novel bending mode.

3 Claims, 4 Drawing Sheets

EXERCISE AND STRESS-RELIEF DEVICE

BACKGROUND OF THE INVENTION

In today's fast paced society, setting aside time for exercise and workouts is increasingly difficult. Pressures from work, home, and extra curricular activities often take priority over spending time improving physical and mental heath.

In the pursuit of improved physical and mental conditioning, many have looked to exercise devices which can be used in the home or office and which allow use when time or weather conditions do not allow outdoor exercise or use of a fitness center. Many of these devices are large and cumbersome. They often require a large amount of floor space and they are often complicated and expensive. A need exists for a simple, low-cost device which can be used for exercise at work or home and can also be used as a stress-relief device.

A number of compact devices have been disclosed in the past for exercising of the hands, arms and torso. An example of such as device is a coil spring exerciser disclosed in U.S. Pat. No. 4,856,776. This device has spaced inner and outer springs with handles attached to either end. U.S. Pat. No 5,022,648 discloses an aerobic wand with a movable rod to render a spring mechanism operable or inoperable. These and other spring exercise devices are characterized by having a single relaxed shape or position in which the device returns when an external bending force is removed. These devices also tend to be large and unwieldy.

SUMMARY OF THE INVENTION

An object of the present invention is to provide a spring action exercise and stress-relief device which has a hysteresis or lag effect to the spring action to provide additional exercising effect.

A further object of the present invention is to provide an exercise and stress-relief device which has an infinite number of rest or relaxed positions.

Yet a further object of the present invention is to provide an exercise and stress relief device in which a novel spring action increases the likelihood of use as a stress-relief device.

A further object of the present invention is to provide an exercise and stress-relief device which is small and lightweight for easy storage and use.

A further object of the present invention is to provide an exercise and stress-relief device which has a resilient cover for comfortable gripping of the device.

Still a further object of the present invention is to provide an exercise and stress-relief device which is simple and inexpensive.

The present invention comprises a bending tube and a cover. The bending tube comprises a spring element and a friction element. The friction element results in a hysteresis effect to the spring action, resulting in an infinite number of relaxed positions of the device. Application of an external bending force will result in decreasing the radius of curvature of the device until a critical radius of curvature is reached. Until this point is reached, the device will maintain its shape upon removal of the bending force. Upon application of a bending force above that required to reach the critical radius of curvature, the device will bend further with a conventional spring action. Releasing the bending force will result in a relaxation or straightening of the shape to the critical radius. A reversed bending force is required to increase the radius of curvature to more than the critical radius. In other words, a reverse bending force is required to straighten the device straighter than the critical radius.

The hysteresis spring action results in a device which utilizes additional muscles and muscle effort to bend and straighten the device compared to simple spring action. The novel effect of the straightening and bending is also a stress-relieving method for many.

In the preferred embodiment, the bending tube comprises a helical spring longitudinally disposed in the device. A friction element comprising a coil is tightly wound in the grooves between adjacent windings of the spring, separating the windings from the normal relaxed position of the spring. The friction resulting from the engagement of the coil and the spring windings produces a hysteresis effect in the spring action. In the preferred embodiment, the bending tube is covered by a resilient foam cover. End caps cover the bending tube and protect the user and prevent marring furniture, etc. which may result from contact with the ends of the bending tube.

An alternative embodiment of the present invention utilizes a plurality of spring wires disposed longitudinally in the device. A helical coil is wound tightly enough to produce a substantial frictional effect between adjacent spring wires. The frictional effect produces a hysteresis effect in the spring action of the bending tube.

BRIEF DESCRIPTION OF THE DRAWINGS

These and other features, aspects and advantages of the present invention will become better understood with regard to the following description, appended claims and accompanying drawings where:

DETAILED DESCRIPTION

Figure 1:
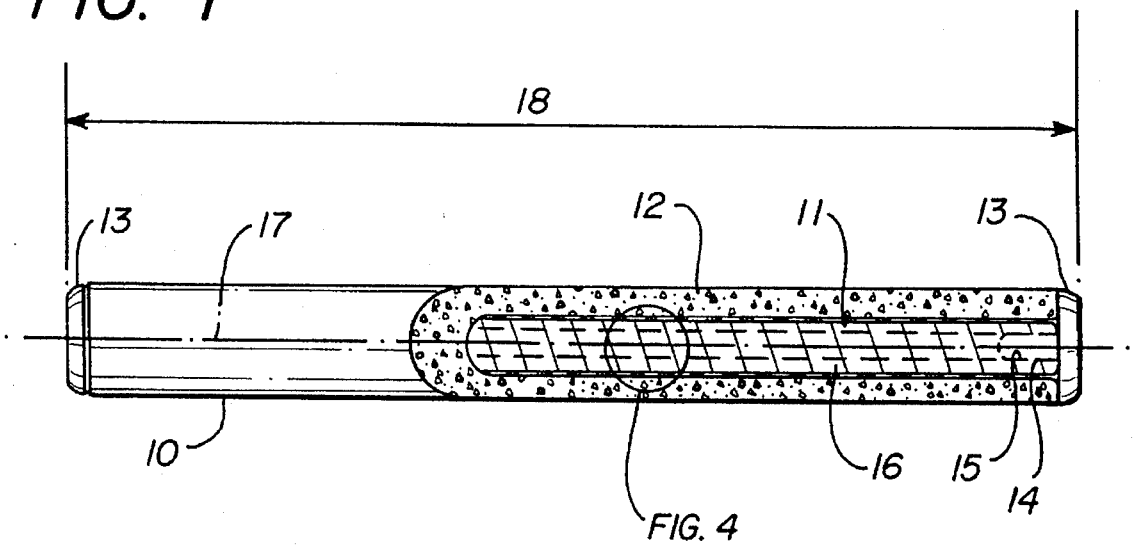
FIG. 1 is an elevation drawing of the preferred embodiment of the present invention with part of the tube cover removed.

FIG. 1 is an elevation drawing of the preferred embodiment of exercise device 10. Bending tube 11 is covered by tube cover 12. Tube cover 12 provides a comfortable grip surface for the hands and in the preferred embodiment protects the hands from abrasion or pinching from the bending tube. Tube cover 12 may be of any suitable material to perform this function. In the preferred embodiment, tube cover 12 is a resilient foam, such as an extruded polyurethane foam. The inner diameter (not shown) of cover 12 is less than the outer diameter (not shown) of bending tube 11, resulting in an interference fit of cover 12 to tube 11.

End caps 13 are fitted to end 14 of tube 11 to cover the end of tube 11 and cover 12. In the preferred embodiment, end cap dowel 15 of end cap 13 forms an interference fit with bending tube inner diameter 16. End caps 13 protect the user and furniture, etc. from contact with bending tube 11. End caps may be of any suitable material. In the preferred embodiment, end caps 13 are of a resilient plastic material.

Bending tube 11 is a bendable tube with a hysteresis spring action. The hysteresis spring action is the result of a frictional element (described below) engaging a longitudinal spring (described below) in the bending tube to produce a hysteresis or "lagging" spring effect in the tube. This hysteresis spring effect means that exercise device 10 may be bent from a straight position shown in FIG. I to a curved position as shown in FIG. 2 and device 10 will remain in the curved position without an external force maintaining it in the curved position.

Figure 2:
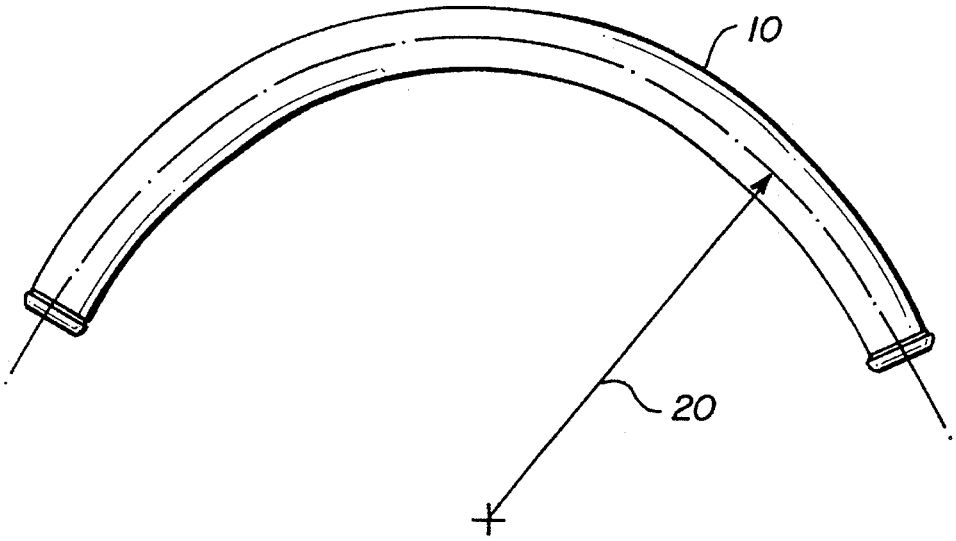
FIG. 2 is an elevation drawing of the preferred embodiment of the present invention after a bending force has been applied and removed from the device.
Figure 3:
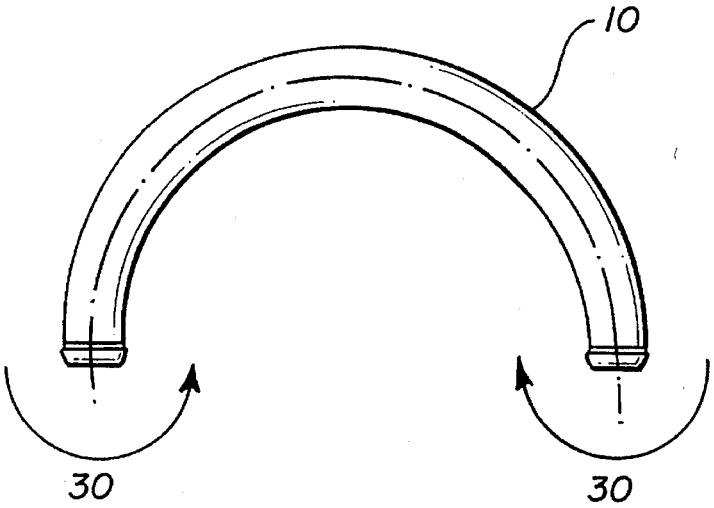
FIG. 3 is an elevation drawing of the preferred embodiment of the present invention with a bending force applied to reduce the radius of curvature below the critical radius of curvature.

The hysteresis spring effect of bending tube 11 results in a critical bending radius 20 of FIG. 2 which defines the minimum radius of curvature 20 which device 10 will maintain without an external bending force applied. When a bending force couple (30 of FIG. 3) less than that required to reach the critical bending radius is applied to the device, the device will maintain the radius of curvature attained when the bending force is removed. When a bending force couple 30 of FIG. 3, greater than that required to reach the critical bending radius is applied to the device, the device continues to bend to a radius of curvature less than the critical value as shown in FIG. 3. Upon removal of bending force couple 30, device 10 will resume the approximate critical radius of curvature shown in FIG. 2. In the preferred embodiment of the present invention, the critical bending radius should be ¼–¾ of the overall length (18 of FIG. 1 ) of the device. The preferred critical radius is approximately ⅓ of the overall length. The preferred length of the device is 10"–12" for a hand/arm exercising device and 2'–3' for an arm/upper torso exercise device.

Figure 4:
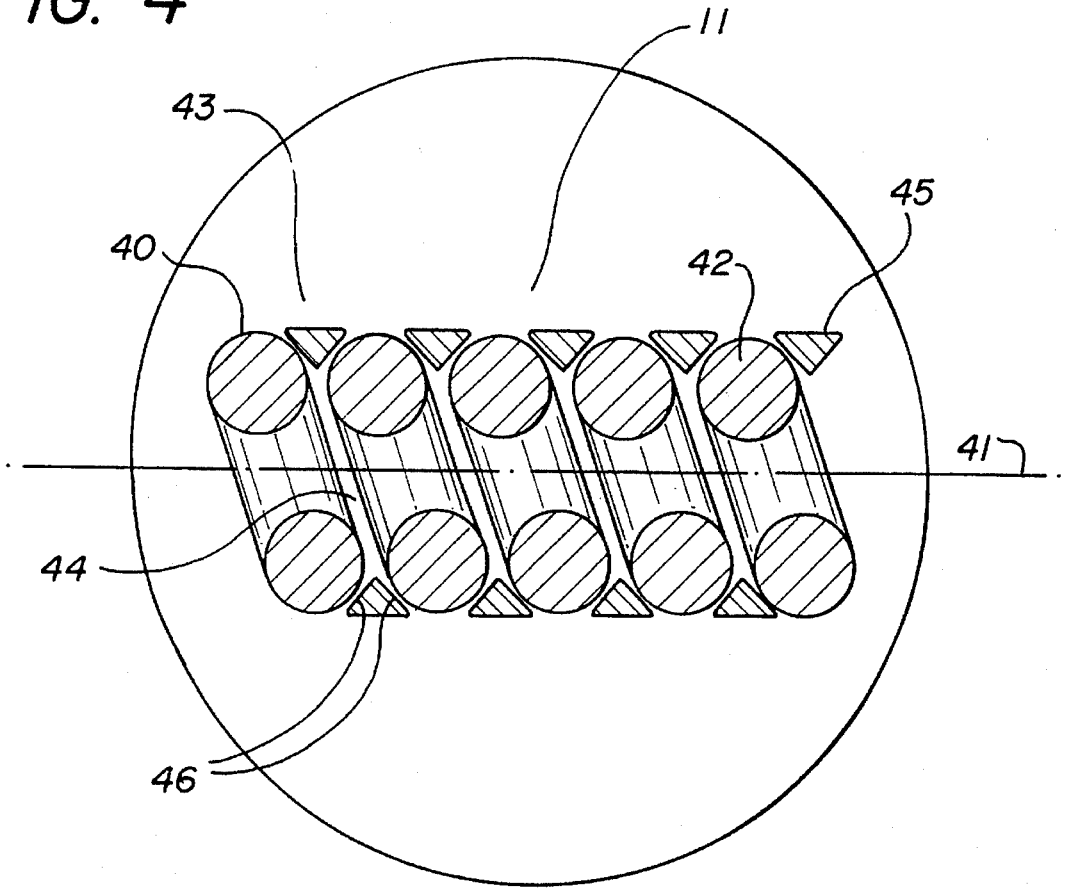
FIG. 4 is a detail cross section of the bending tube of the preferred embodiment of the present invention showing the spring and coil.

FIG. 4 is a detailed cross section of the preferred embodiment of bending tube 11, which is available under the trade name Type D Flexible Tube from Vermont Flexible Tubing Company of Londonville, Vt. Spring 40 is a tightly wound helical spring with a longitudinal axis 41 coaxial with the longitudinal axis 17 of exercise device 10. Coil 43 is a helical coil having a wire with a triangular cross section as shown in coil winding 45. Coil 43 is tightly wound in grooves 44 between spring windings 42 of spring 40 so that spring windings 42 are extended or spread apart from their normal relaxed state. Tight winding of coil 43 results in substantial frictional engagement between coil winding 45 and adjacent spring windings 42 at frictional engagement points 46. The frictional engagement of spring 40 and coil 43 results in the hysteresis spring effect of tube 11. The frictional engagement can be adjusted to obtain the desired critical radius by the tightness of the coil winding 45 of coil 43 and hence the amount of spreading of spring windings 42 of spring 40. Alternatively, the dimensions of coil winding 45, spring winding 42, or the diameter of spring 40 can be changed to adjust the frictional engagement or spring effect.

In the preferred embodiment of the present invention, spring 40 is 0.135 oil-tempered spring wire. Coil 43 is 0.125"×0.075" hot-dipped galvanized soft drawn steel wire. The tube inner diameter is 0.310" and the tube outer diameter is 0.605". The length of the tube is 10"–12".

Figure 5:
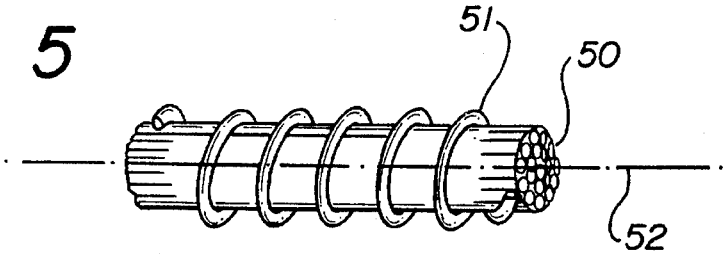
FIG. 5 is a perspective drawing of an alternative embodiment of the bending tube of the present invention.

FIG. 5 is a perspective drawing of an alternative embodiment of bending tube 11. Longitudinal spring wires 50 are disposed longitudinally in exercise device 10 with longitudinal axis 52 coaxial with axis 17 of FIG. 1. Helical wire 51 is wrapped tightly around longitudinal spring wires 50 to produce a frictional engagement between wires 50. The frictional effect of wires 50 results in a hysteresis effect of bending tube 11. The number, diameter and material of wires 50, along with the tightness of the winding of helical wire 51, may be adjusted to obtain the desired critical radius of curvature.

Figure 6:
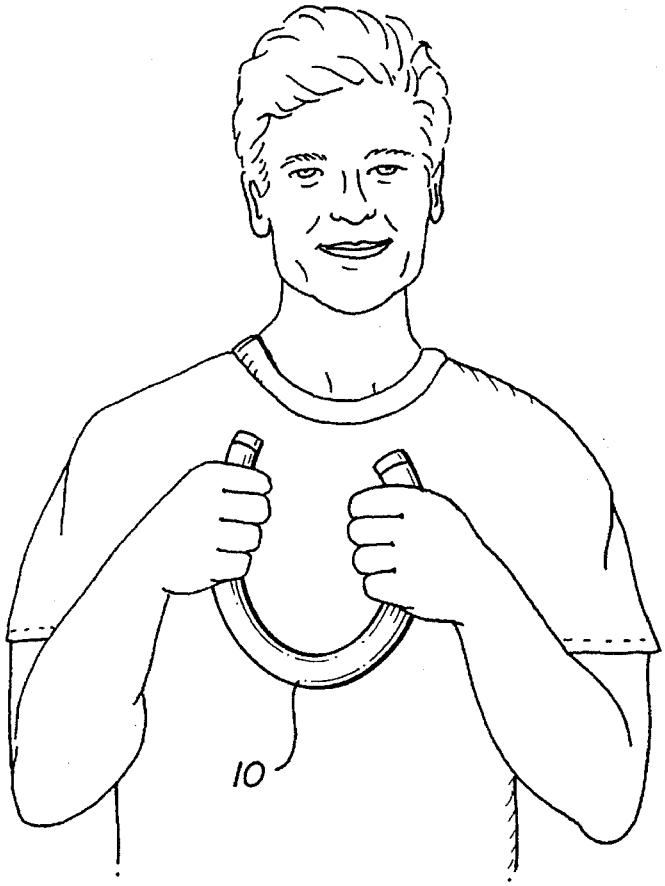
FIG. 6 is a perspective drawing of the preferred embodiment of the present invention being used as a hand/arm exercising device.

FIG. 6 is a perspective of exercise device 10 being used as a hand/arm exerciser. In use, the exercise device is bent into an arc by the arm and hand muscles of the body. Until the radius of curvature of the device reaches the critical radius of curvature, the arc is maintained when the bending force is removed. When the bending force is sufficient to reduce the radius of curvature to less than the critical radius, the device will act as a conventional spring device. The device will return to the critical radius of curvature when the bending force is removed. A counter bending force is required to return the device to a straight position as shown in FIG. 1.

Figure 7:
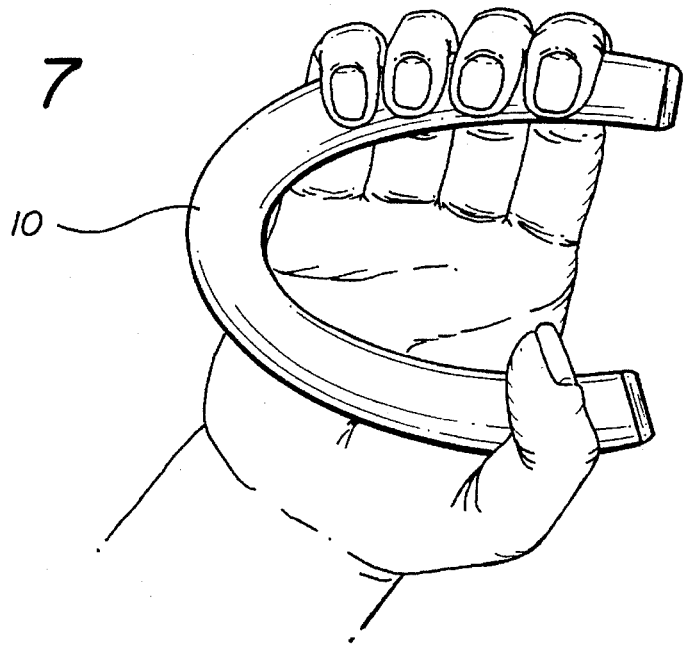
FIG. 7 is a perspective drawing of the preferred embodiment of the present invention being used as a hand exercising device.

FIG. 7 is a perspective drawing of the exercise device 10 being used as a hand exercise device. No force is required to maintain the device in an arc greater than or equal to the critical radius of curvature.

Figure 8:
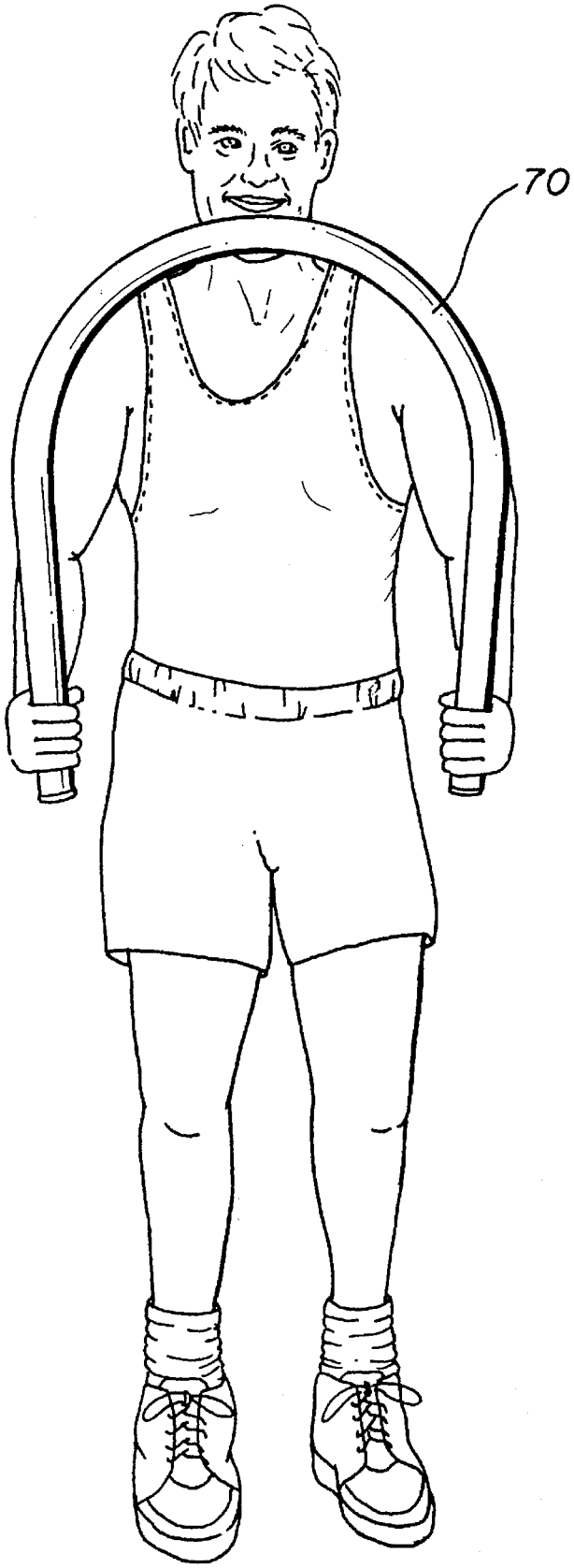
FIG. 8 is a perspective drawing of an alternative embodiment of the present invention being used as an arm/upper torso exercising device.

FIG. 8 is a perspective drawing of another alternative embodiment of the exercise device used as an arm/upper torso exercise device. The length of the device is 2'–3' with a diameter of 1"–2".

The device 10 may also be used as a stress-reduction device, allowing the user to perform bending, stretching, compression or twisting motions on the device while relaxing, sitting, reading, watching television or any number of activities.

Accordingly the reader will see the exercise and stress-relief device provides a bending device which maintains a significant radius of curvature when the bending force is removed. The device comprises the following additional advantages:

it provides exercise not obtained with a simple spring device;

it can be used to exercise various parts of the body;

the use of a foam sleeve improves grip and comfort;

it is an effective stress relief device; and it is simple and can be manufactured at low cost.

Although the description above contains many specifications, these should not be construed as limiting the scope of the invention but as merely providing illustrations of some of the presently preferred embodiments of this invention. For example, the tube may be weighted or a plastic tube may be used to frictionally engage a spring, etc.

Thus the scope of the invention should be determined by the appended claims and their legal equivalents, rather than by the examples given.

I claim:

1. An exercise and stress-relief device consisting essentially of:

(a) a bending tube comprising a helical spring and a coil, the windings of the coil engaging the grooves of the spring windings with sufficient tightness to result in a hysteresis effect in a spring action of the tube when the tube is bent from a straight position during exercise;

said helical spring comprises a wire of circular cross section and the coil comprises a wire of triangular cross section, two sides of the triangular cross section engaging adjacent windings of the spring; and (b) an outer resilient foam tube cover covering the tube.

2. A device as in claim 1 wherein the spring is tightly wound with the adjacent windings in contact when in a relaxed position, so that when wound with the coil, the coil separates the adjacent windings of the spring sufficiently to produce the hysteresis effect.

3. A device as in claim 1 additionally comprising at least one end cap covering an end of the tube.

* * * * *